US006128800A

United States Patent [19]

Vosbikian

[11] Patent Number: 6,128,800

[45] Date of Patent: Oct. 10, 2000

[54] ROTATABLE BRUSH HEAD

[75] Inventor: Peter S. Vosbikian, Moorestown, N.J.

[73] Assignee: Quickie Manufacturing Corporation, Cinnaminson, N.J.

[21] Appl. No.: 09/113,160

[22] Filed: Jul. 10, 1998

[51] Int. Cl.[7] ..... A46B 15/00

[52] U.S. Cl. ..... 15/172; 15/144.2; 15/145; 15/176.2; 403/97

[58] Field of Search ..... 15/144.1, 144.2, 15/145, 176.1, 176.2, 172; 403/97, 94, 84

[56] References Cited

U.S. PATENT DOCUMENTS

| | | | |
|---|---|---|---|
| 589,351 | 8/1897 | Humbach | 15/144.1 |
| 855,152 | 5/1907 | Wilson | 15/144.1 |
| 1,134,915 | 4/1915 | Severns | 15/144.1 |
| 1,617,329 | 2/1927 | Glover | 15/144.1 |
| 1,899,090 | 2/1933 | Goard | 15/144.1 |
| 3,360,286 | 12/1967 | Smyth | 15/144.2 |
| 3,704,479 | 12/1972 | Whitaker | 15/172 |
| 3,886,618 | 6/1975 | Paoletti | 15/172 |
| 4,517,700 | 5/1985 | Pinto | 15/105 |
| 4,528,714 | 7/1985 | Beck | 15/144.1 |
| 4,614,452 | 9/1986 | Wang | 403/97 |
| 4,658,461 | 4/1987 | Roe | 15/210.1 |
| 4,763,377 | 8/1988 | Madsen | 15/144.2 |
| 4,796,324 | 1/1989 | Sartori | 15/144.1 |
| 4,901,392 | 2/1990 | Shapiro | 15/172 |
| 5,207,755 | 5/1993 | Ampian | 15/144.2 |
| 5,414,889 | 5/1995 | Sartori | 15/159.1 |
| 5,520,474 | 5/1996 | Liu | 403/97 |
| 5,655,250 | 8/1997 | Warrell | 15/144.2 |

OTHER PUBLICATIONS

Butler Broom (photographs attached).

*Primary Examiner*—Robert J. Warden, Sr.
*Assistant Examiner*—Theresa T. Snider
*Attorney, Agent, or Firm*—Stuart M. Goldstein

[57] ABSTRACT

A broom is provided with a rotatable brush head connected to a handle. The brush head and handle each have a longitudinally extending axis located in a common geometric plane. The brush head has a base with a downwardly extending element which, by tongue and groove configuration, engages a separable attachment member which is adapted to receive the handle. A manually operable member with a knob, controls the movement of the attachment element and hence the handle in relation to the brush head, allowing the brush head to rotate to a plurality of angles of alignment with the handle within the common plane. The brush head element, attachment member, and control member are secured together by means of a spring bias system, consisting of an elongated bolt or similar means and a coiled spring. This system secures the attachment member and control member to the brush head in a tightly biased manner, to maintain the brush head in position on the handle. Loosening the attachment member by rotating the control member allows the brush head to rotate to various angles, for instance 10°, 45°, and 90°, to the handle. Tightening the control member fixes the brush head at a given selected angle.

20 Claims, 6 Drawing Sheets

ROTATABLE BRUSH HEAD

BACKGROUND OF THE INVENTION

The advantages of brooms with brush heads which are pivotal, rotatable, or otherwise moveable in relation to their handles are well-known. Such brooms can be used to sweep areas which brooms with fixed brush heads find difficult to enter. Moveable brush heads also allow ease of cleaning, as the position of the heads can be changed to do various and varied jobs. Bristles on fixed broom heads also result in being worn unevenly and becoming deformed, as all bristles do not move to the same degree in such brooms.

However, while brooms with moveable heads are known, several inherent problems are present. First, the majority of prior art brooms, as exemplified by U.S. Pat. No. 5,414,889, do not teach the application of a broom head which pivots within the geometric plan of the longitudinal axis of the broom handle, i.e. side to side, in relation to the handle. While some prior products do disclose a side to side pivoting action of the handle in relation to the broom head, the manner of controlling this rotation, employing components like those shown in U.S. Pat. No. 5,414,889, are subject to excessive wear and imprecise control. The mechanisms for adjusting the angles of alignment between the brush heads and the handles are also often impractical to operate and use (see, for example, U.S. Pat. No. 4,763,377).

In most prior devices, adjustment systems do not allow precise angles of alignment and once adjusted, such brush heads often fail to maintain the angles which are set. Also, required positions of the brush head for convenient and effective cleaning often can not be attained (see for example U.S. Pat. Nos. 3,704,479, and 4,901,392). Over and above this, none of the prior art discloses or teaches the unique features and results of the rotatable brush head of the present invention.

SUMMARY OF THE INVENTION

It is thus the object of the present invention to overcome the limitations and disadvantages of prior moveable broom and brush heads.

It is the object of the present invention to provide a rotatable broom or brush head which is simple, convenient and efficient in use.

It is another object of the present invention to provide a rotatable broom or brush head which is securely maintained in position during sweeping operation.

It is a further object of the present invention to provide rotatable boom or brush head which is easily and conveniently adjustable to maintain a plurality of precise angles of alignment.

It is another object of the present invention to provide a rotatable broom or brush head which can be used in locations otherwise inaccessible to normal brooms.

It is a further object of the present invention to provide a rotatable broom or brush head which can be used in a variety of sweeping and cleaning modes.

These and other objects are accomplished by the present invention which comprises a broom with a rotatable brush head connected to a handle. The brush head and handle each have a longitudinally extending axis located in a common geometric plane. The brush head has a base with a downwardly extending element which, by tongue and groove configuration, engages a separable attachment member which is adapted to receive the handle. A manually operable member with a knob controls the movement of the attachment element and hence the handle in relation to the brush head, allowing the brush head to rotate to a plurality of angles of alignment with the handle, within the common plane. The brush head element, attachment member, and control member are secured together by means of a spring bias system, consisting of an elongated bolt or similar means and a coiled spring. This system secures the attachment member and control member to the brush head in a tightly biased manner, to maintain the brush head in position on the handle. Loosening the attachment member by rotating the control member allows the brush head to rotate to various angles, for instance 10°, 45°, and 90°, to the handle. Tightening the control member fixes the brush head at the selected angle.

The novel features which are considered as characteristic of the invention are set forth in particular in the appended claims. The invention, itself, however, both as to its design, construction, and use, together with the additional features and advantages thereof, are best understood upon review of the following detailed description with reference to the accompanying drawings.

DETAILED DESCRIPTION OF THE DRAWINGS

Figure 1:
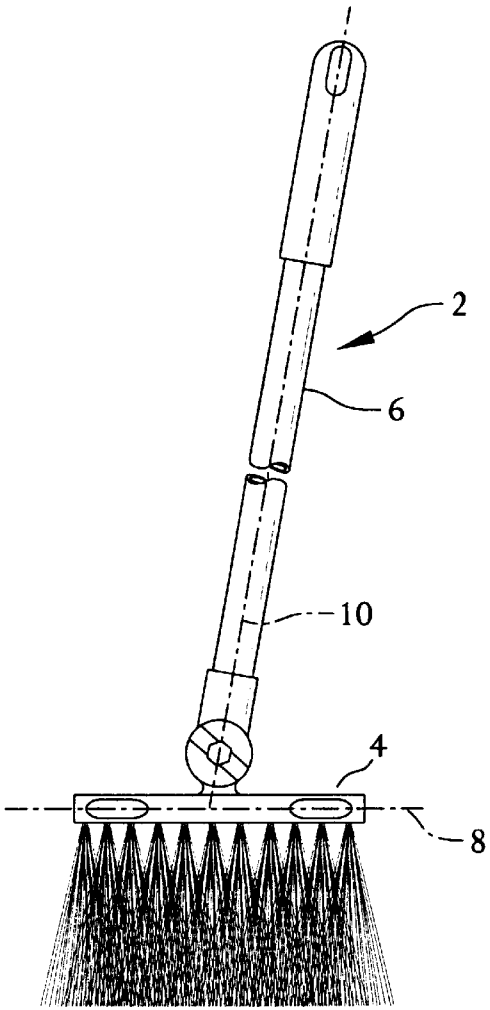
FIG. 1 is an elevation view of the broom of the present invention with its handle in a 10° angled position for sweeping.

Broom 2 comprises brush head 4 and handle 6. Brush head 4 has a longitudinal axis 8 running lengthwise of the head. Longitudinal axis 10 of handle 6 runs the length of the handle, within a common geometric plane as axis 8 of brush head 4.

Brush head 4 has a base 12 with bristles 14 emanating therefrom. While bristles on a broom are specifically disclosed, it is contemplated that the rotatable head of this invention can be used with any tool employing the need for a brush with a elongated handle, e.g. for sweeping, cleaning, painting, etc.

Figure 13:
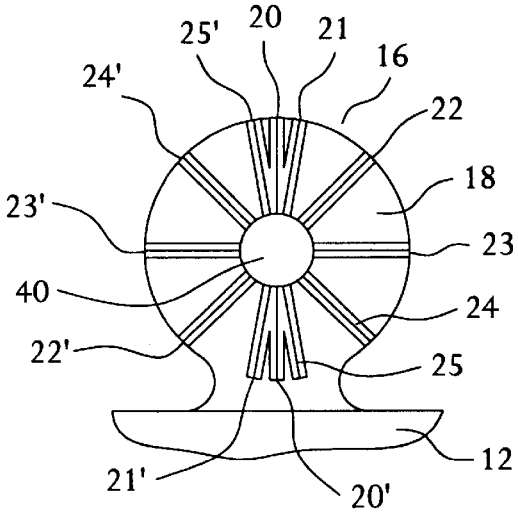
FIG. 13 is an enlarged elevation view of the preferred embodiment of the brush head element.

Extending from base 12 is brush head element 16. As best seen in FIG. 13, element 16 consists of flat inner surface 18 with grooves 20-20', 21-21', 22-22', 23-23', 24-24' and 25-25' extending diametrically across the surface, each dual set of grooves being interrupted by opening 40. Element 16 can be integral with base 12 or be attached during manufacturing.

Attachment member 28, best seen in FIGS. 5–8, comprises an upwardly extending section 30 with internal threads 32 to receive the threaded end 33 of handle 6. Lower section 34 of member 28 comprises an inner flat surfaces 36, outer flat surface 38, and a back inset wall 39. Surface 36 has an elongated ridged tongue member 42 extending diametrically across the surface 36, interrupted only by opening 44 through attachment member 28.

Surface 36 of attachment member 28 is configured to slidably rotate on the flat surface 18 of the brush head element 16 and tongue member 42 is configured to engage and fit into grooves 20–25' of element 16.

Figure 10:
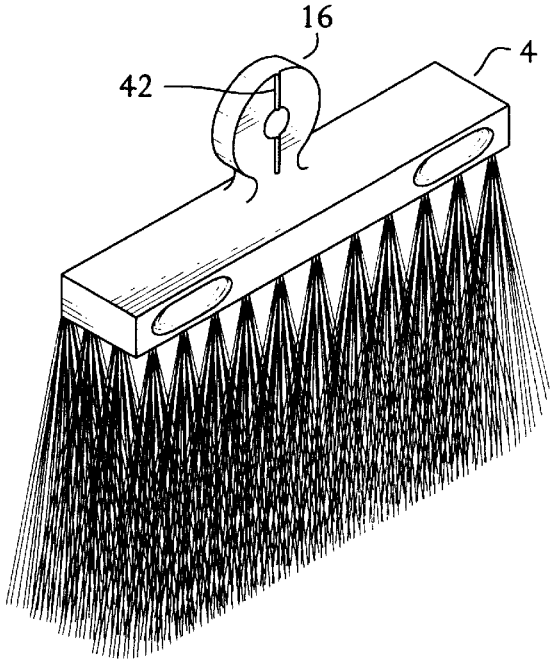
FIG. 10 is a perspective view of an alternate embodiment of the brush head of the invention.
Figure 11:
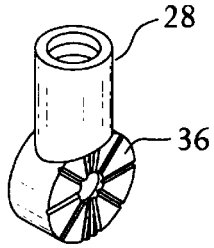
FIG. 11 is a perspective view of an alternate embodiment of the handle attachment member of the invention.
Figure 12:
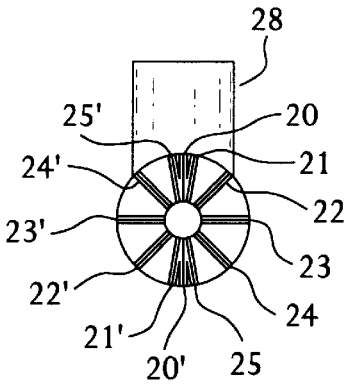
FIG. 12 is an elevation view of the alternate embodiment of the handle attachment member of the invention.

It is contemplated, as shown in FIGS. 10–12, that grooves 20–25', instead of being configured within flat surface 18 of brush head element 16, could be located within flat surface 36 of attachment member 28; and tongue member 42, instead of being on flat surface 36, could be configured on brush head element 16. This simple reversal of the tongue and groove configuration is a modification within the scope contemplated by the invention.

Manual control member 46 has inset wall 45 and flat inner surface 48, which surface is designed to slidably rotate on surface 38 of attachment member 28. Control member 46 has knob 50 for finger control rotation of member 46 and hence control of the rotation of brush head 4, as more fully explained below.

An elongated attachment, for instance bolt 52, is positioned in and extends from manual control member 46. The head of bolt 52 rests in opening 57 in control member 46. Bolt 52 extends through opening 44 in attachment member 28, and then through opening 40 of brush head element 16, where it is secured by means of nut 54 located in an inset cavity 55 in element 16. Nut 54 is itself peened and secured within cavity 55, so that it can not be removed.

Coil spring 56 surrounds bolt 52, with one end pressed against the inset wall 45 of manual control member 46 and the other end pressed against the back inset wall 39 of opening 44 of attachment member 28. When brush head element 16, attachment member 28, and manual control member 46 are in alignment and secured together by bolt, spring 56 provides bias compressive forces against member 46 and through the other components of the system.

For straight on sweeping operation, tongue member 42 of attachment member 28 is in fitted engagement with groove 20–21' of brush head element 16. At this 0° position, handle 6 extends perpendicularly from brush head 4, shown as position A in FIG. 2. Manual control member 46 is rotated by manual turning of knob 50, for instance clockwise, to hand tighten bolt 52 within the other components of the system.

Turning control member 46 via knob 50 counterclockwise, will loosen attachment member 28 sufficiently to allow it and attached handle 6 to slidably rotate over flat surface 18 of element 16, in either a clockwise or counterclockwise direction. This allows brush head 4 to rotate within the geometric plane in which axes 8 and 10 are located. It will be appreciated that the bias force from spring 56 acting between control member 46 and attachment member 28 serves to maintain control member 46, attachment member 28, and brush head element 16 connected and in aligned position as attachment member 28 and handle 6 are rotated.

Figure 2:
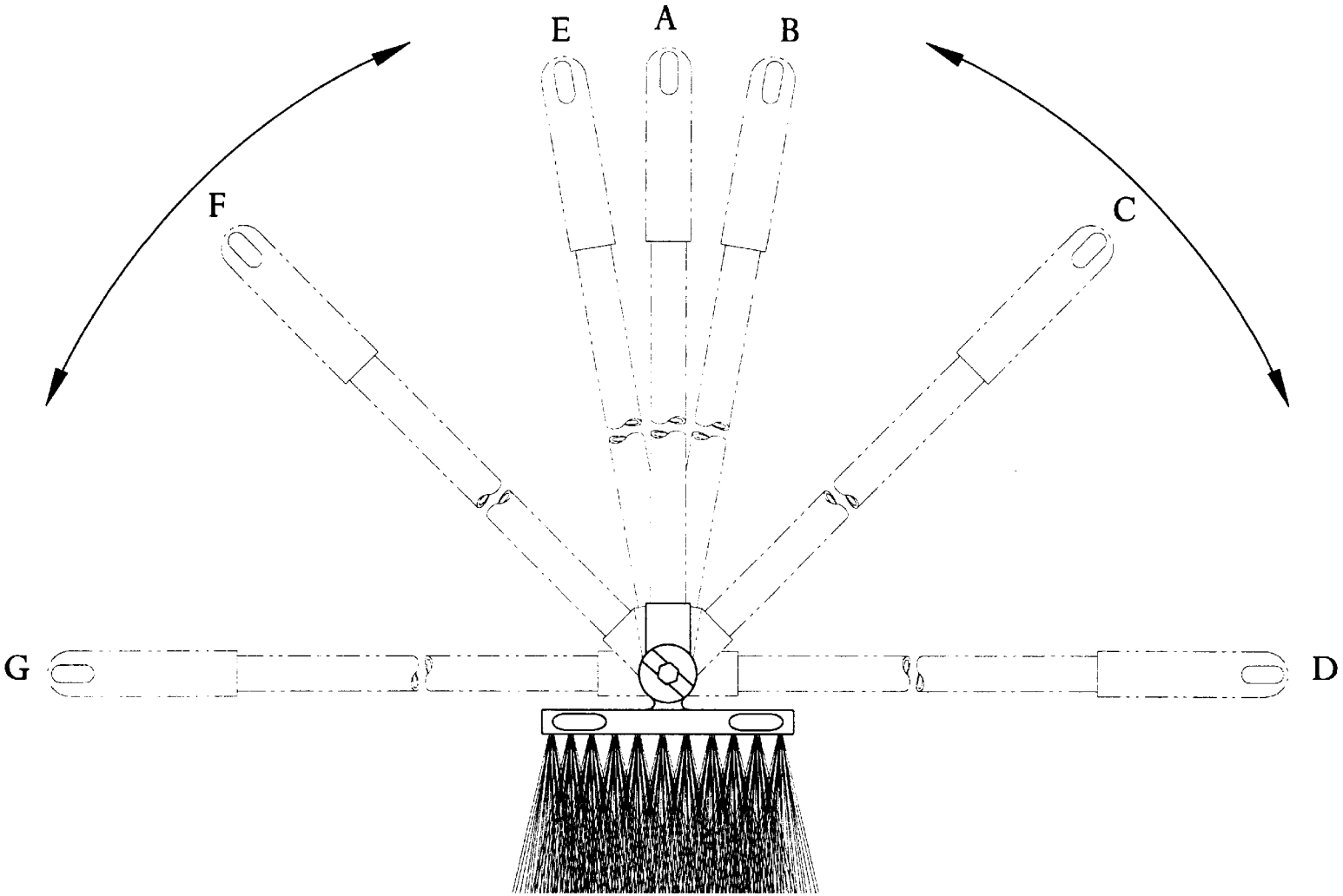
FIG. 2 is an elevation view of the broom of the present invention showing the various available angled positions of the handle.
Figure 3:
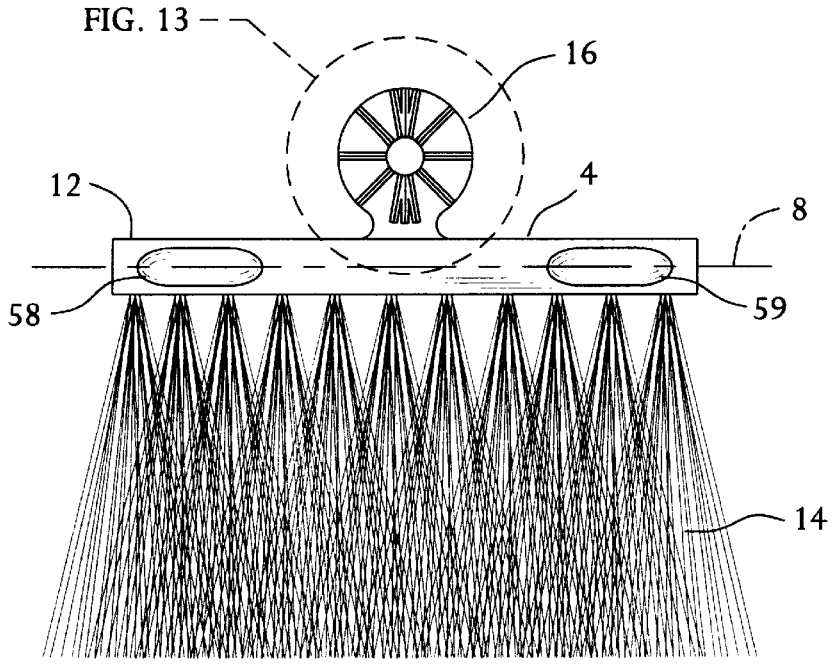
FIG. 3 is an elevation view of the brush head of the invention.
Figure 4:
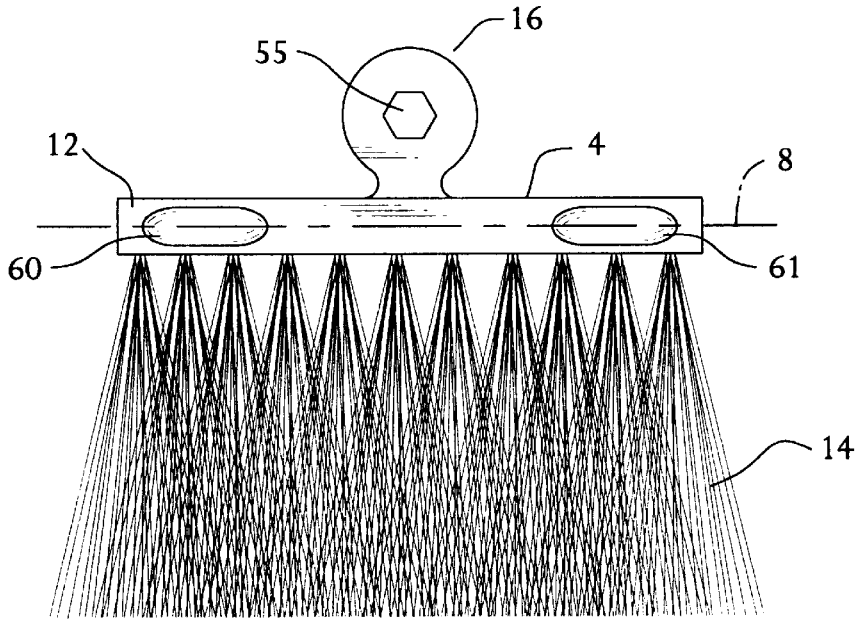
FIG. 4 is an elevation view of the reverse side of the brush head shown in FIG. 3.
Figure 5:
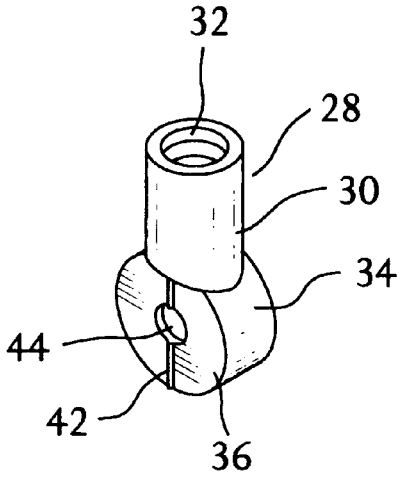
FIG. 5 is a perspective view of one side of the handle attachment member of the invention.
Figure 6:
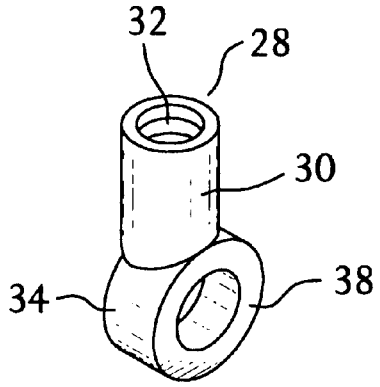
FIG. 6 is a perspective view of the other side of the handle attachment member of the invention.
Figure 7:
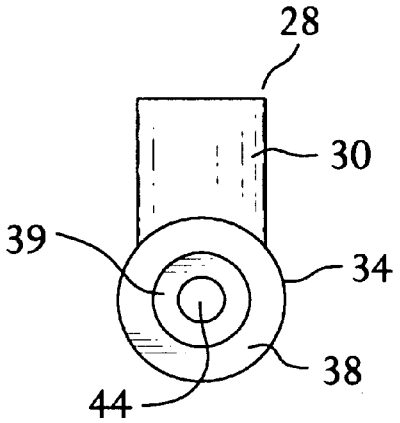
FIG. 7 is an elevation view of one side of the handle attachment member of the invention.
Figure 8:
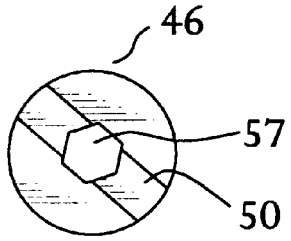
FIG. 8 is an elevation view of the knob and control member of the invention.
Figure 9:
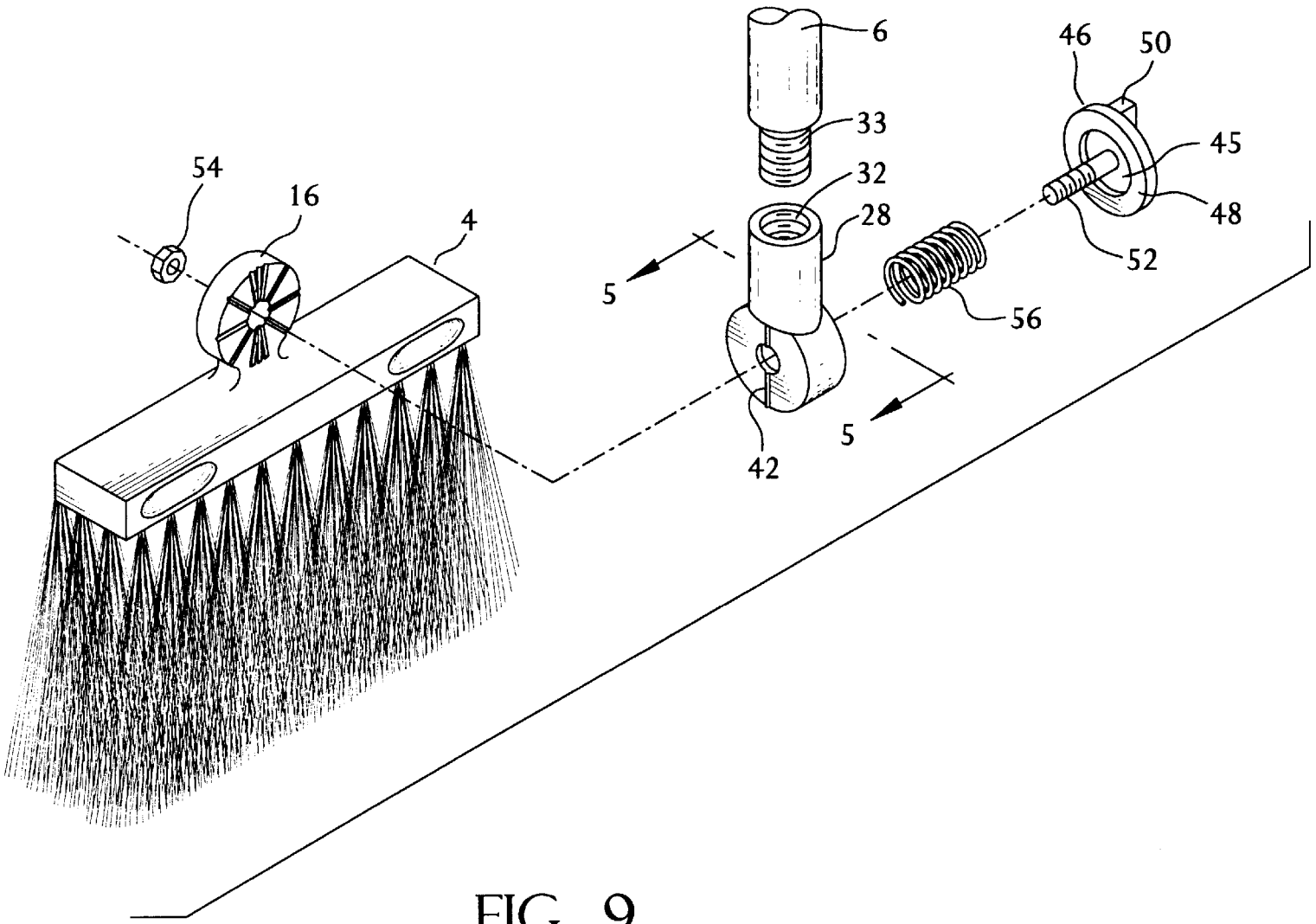
FIG. 9 is an exploded view showing the manner of attachment of the various components of the invention.

When brush head 4 is rotated, for example 10° in one direction, tongue member 42 of member 28 enters groove 21-21' of brush head element 16, thus positioning handle 6 at a 10° angle of alignment with brush head 4, placing the broom in position B shown in FIG. 2 Knob 50 is then hand tightened in a clockwise direction, which secures brush head 4 and handle 6 at this angle and allows broom 2 to be used in this configuration.

Rotating manual control member 46 via knob 50 will again loosen attachment member 28 sufficiently to allow it and attached handle 6 to slidably rotate over flat surface 18 of brush head element 16, permitting brush head 4 to continue rotating in the common geometric plane. It will be appreciated that the extension of grooves 21–25' across flat surface 18 of brush head element 16, allows handle 6 to be securely positioned at 10°, 45° and 90° angles of alignment on either side of longitudinal axis 10 of the handle. FIG. 2 shows handle 6 at 10° angles of alignment at positions B and E, 45° angles of alignment at positions C and F, and 90° angles of alignment at positions D and G. This allows use of broom 2 within two sets of angled positions, thus ensuring that bristles 14 will not be deformed in one direction over time, hence prolonging the life of the bristles and the broom.

Base 12 has depressed dimple areas 58, 59, 60 and 61 on its outer surfaces, which are configured to allow the user to grasp the base when adjusting the angular position of brush head 4, without having to touch bristles 14.

The flexibility of the broom of this invention thus becomes apparent. Broom 2 not only is provided for normal sweeping, but also, since it can be positioned at various angles of alignment, it is easily and quickly converted for convenient use at other jobs. For instance, the 10° angle of alignment allows broom 2 to maintain the normal sweeping angle for routine floor cleaning, as shown in FIG. 1. At 45° angles of alignment, broom 2 can very easily and efficiently be used to sweep behind furniture which is close to wall surfaces. At 90° angles of alignment, with handle 6 parallel to axis 8 of brush head 4, broom 2 can easily be used to sweep or otherwise brush a wall shelf or furniture surface.

Certain novel features and components of this invention are disclosed in detail in order to make the invention clear in at least one form thereafter. However, it is to be clearly understood that the invention as disclosed is not necessarily limited to the exact form and details as disclosed since it is apparent that various modifications and changes may be made without departing from the spirit of the invention.

What is claimed is:

1. A brush implement comprising:

(a) a handle with a longitudinally extending central axis;

(b) a brush head with a base and bristles emanating from the base, said brush head having a longitudinally extending central axis, the axis of the handle and the axis of the head being located in a common geometric plane; and (c) attachment means for rotatably connecting the handle to the brush head in a plurality of angles of alignment within the geometric plane, said attachment means comprising:

(1) a brush head element extending from the base, said element having an inner surface which is substantially flat, the inner surface further comprising first engagement means for maintaining the position of the brush head in different angles of alignment in relation to the handle;

(2) a separable handle member which is rotatable to a plurality of angles of alignment with the brush head element within the geometric plane, the handle member having means for accepting the handle and a flat inner surface and a flat outer surface, said inner surface comprising second engagement means for maintaining the position of the handle in different angles of alignment in relation to the brush head, the flat inner surface of the handle member being configured to slideably rotate on the flat inner surface of the brush head element, within the geometric plane, said second engagement means being configured to engage said first engagement means when the brush head is maintained at an angle of alignment with the handle; and (3) separable manual control means for controlling rotating movement of the brush head element and the handle member, said manual control means comprising a flat inner surface configured to slideably rotate on the flat outer surface of the handle member and further being slideably rotatable in a plane parallel to the geometric plane, rotation of the control means permitting disengagement of the first and second engagement means, rotation of the handle member, and changes in the angles of alignment between the brush head and the handle said manual control means further comprising spring bias means for ensuring for a tight bias engagement between the first and second engagement means.

2. A brushing implement as in claim 1 in which the first engagement means comprises a plurality of groove means for accepting the second engagement means.

3. A brushing implement as in claim 2 in which the second engagement means comprises elongated ridge means for placement within the groove means.

4. A brushing implement as in claim 1 in which the second engagement means comprises elongated ridge means for placement within the first engagement means.

5. A brushing implement as in claim 1 in which the first engagement means comprises elongated ridge means for placement within the second engagement means.

6. A brushing implement as in claim 5 in which the second engagement means comprises a plurality of groove means for accepting the ridge means.

7. A brushing implement as in claim 1 in which the second engagement means comprises a plurality of groove means for accepting the first engagement means.

8. A brushing implement as in claim 1 in which the manual control means comprises a knob for rotation of the control means, whereby rotation of the knob in one direction allows changes in the angles of alignment between the brush head and handle, and rotation in the another direction locks the brush head and handle in a single angle of alignment.

9. A brushing implement as in claim 8 further comprising an elongated connector for securing the brush head element, the handle member, and the manual control means.

10. A brushing implement as in claim 1 further comprising an elongated connector for securing the brush head element, the handle member, and the manual control means.

11. A brushing implement comprising a handle and a brush head with a longitudinally extending central axis, said implement further comprising:

(a) a brush head element extending from the head;

(b) a separable, rotatable handle attachment member which is rotatable to a plurality of angles of alignment with the brush head within a geometric plane containing the axis;

(c) tongue and groove engagement means for rotatably engaging the brush head clement and the handle attachment member;

(d) a separable manual control means for controlling the rotation between the brush head element and the handle attachment member, said control means being slideably rotatable in a plane parallel to the axis and comprising a surface which slideably rotates on the handle attachment member;

(e) spring bias connection means providing rotatably bias engagement of the brush head member, handle attachment member, and control means, whereby upon rotation of the manual control means in the plane parallel to the axis, the handle attachment member rotates and changes the alignment between the brush head and the handle.

12. A brushing implement as in claim 11 in which the tongue and groove engagement means comprises a plurality of grooves on the brush head element and an elongated ridge on the handle attachment member.

13. A brushing implement as in claim 11 in which the tongue and groove engagement means comprises a plurality of grooves on the handle attachment member and an elongated ridge on the brush head element.

14. A brushing implement as in claim 11 in which the spring bias connection means comprises an elongated connector traversing through the brush head element, the handle attachment member and the manual control means.

15. A brushing implement as in claim 14 in which the spring bias connection means further comprises a spring member surrounding a elongated connector.

16. A brushing implement as in claim 11 in which the spring bias connection means comprises a spring member positioned within the brush head element, the handle attachment member, and the manual control means.

17. A brushing implement as in claim 11 in which the manual control means comprises a knob for rotation of the control means, whereby rotation of the knob in one direction allows changes in the angles of alignment between the brush head and handle, and rotation in another direction locks the brush head and handle in a single angle of alignment.

18. A brushing implement as in claim 14 in which the angles of alignment include angles of 0°, 10°, 45°, and 90°.

19. A brush implement comprising:

(a) a handle with a longitudinally extending central axis;

(b) a brush head with a base and bristles emanating from the base, said brush head having a longitudinally extending central axis, the axis of the handle and the axis of the head being located in a common geometric plane; and (c) attachment means for rotatably connecting the handle to the brush head in a plurality of angles of alignment within the geometric plane, said attachment means comprising:

(1) a brush head element extending from the base, said element having an inner surface which is substantially flat, the inner surface further comprising first engagement means for maintaining the position of the brush head in different angles of alignment in relation to the handle;

(2) a separable handle member which is rotatable to a plurality of angles of alignment with the brush head element within the geometric plane, the handle member having means for accepting the handle and a flat inner surface and a flat outer surface, said inner surface comprising second engagement means for maintaining the position of the handle in different angles of alignment in relation to the brush head, the flat inner surface of the handle member being configured to slideably rotate on the flat inner surface of the brush head element, within the geometric plane, said second engagement means being configured to engage said first engagement means when the brush head is maintained at an angle of alignment with the handle;

(3) separable manual control means for controlling rotating movement of the brush head element and the handle member, said manual control means comprising a flat inner surface configured to slideably rotate on the flat outer surface of the handle-member and further being slideably-rotatable in a plane parallel to the geometric plane, rotation of the control means permitting engagement of the first and second engagement means, rotation of the handle member, and changes in the angles of alignment between the brush head and the handle; and (4) an elongated connector for securing the brush head element, the handle member, and the manual control means.

20. A brush implement comprising:

(a) a handle with a longitudinally extending central axis;

(b) a brush head with a base and bristles emanating from the base, said brush head having a longitudinally extending central axis, the axis of the handle and the axis of the head being located in a common geometric plane; and (c) attachment means for rotatably connecting the handle to the brush head in a plurality of angles of alignment within the geometric plane, said attachment means comprising:

(1) a brush head element extending from the base, said element having an inner surface which is substantially flat, the inner surface further comprising first engagement means for maintaining the position of the brush head in different angles of alignment in relation to the handle;

(2) a separable handle member which is rotatable to a plurality of angles of alignment with the brush head element within the geometric plane, the handle member having means for accepting the handle and a flat inner surface and a flat outer surface, said inner surface comprising second engagement means for maintaining the position of the handle in different angles of alignment in relation to the brush head, including angles of alignment of 0°, 10°, 45°, and 90° on either side of the longitudinal axis of the handle, the flat inner surface of the handle member being configured to slideably rotate on the flat inner surface of the brush head element, within the geometric plane, said second engagement means being configured to engage said first engagement means when the brush head is maintained at an angle of alignment with the handle; and (3) separable manual control means for controlling rotating movement of the brush head element and the handle member, said manual control means comprising a flat inner surface configured to slideably rotate on the flat outer surface of the handle member and further being slideably rotatable in a plane parallel to the geometric plane, rotation of the control means permitting engagement of the first and second engagement means, rotation of the handle member, and changes in the angles of alignment between the brush head and the handle.

* * * * *